US006290916B1

(12) United States Patent
Sechrist et al.

(10) Patent No.: US 6,290,916 B1
(45) Date of Patent: Sep. 18, 2001

(54) APPARATUS FOR CONTROLLING MOISTURE IN A CATALYST REGENERATION PROCESS

(75) Inventors: Paul A. Sechrist, Des Plaines; Delmar W. Robinson, Palatine; William D. Schlueter, Lake in the Hills, all of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/586,416

(22) Filed: Jun. 1, 2000

Related U.S. Application Data

(62) Division of application No. 09/158,160, filed on Sep. 22, 1998, now Pat. No. 6,123,833.

(51) Int. Cl.[7] ..... B01J 8/26; B01J 38/04

(52) U.S. Cl. ..... 422/145; 422/144; 422/147; 208/140; 502/35

(58) Field of Search ..... 422/144, 145, 422/146, 147; 502/41, 34, 44; 208/140, 150

(56) References Cited

U.S. PATENT DOCUMENTS

| | | | |
|---|---|---|---|
| 2,773,014 | 12/1956 | Snuggs et al. | 196/50 |
| 2,880,168 | 3/1959 | Feller | 208/140 |
| 3,647,680 | 3/1972 | Greenwood et al. | 208/65 |
| 3,652,231 | 3/1972 | Greenwood et al. | 23/288 G |
| 3,692,496 | 9/1972 | Greenwood et al. | 23/288 G |
| 3,939,061 | 2/1976 | Paynter et al. | 208/140 |
| 4,125,454 | 11/1978 | Clem et al. | 208/65 |
| 4,172,027 | 10/1979 | Ham et al. | 208/140 |
| 4,218,338 | 8/1980 | Huin et al. | 252/415 |
| 4,233,268 | 11/1980 | Boret et al. | 422/190 |
| 4,406,775 | 9/1983 | Bailor et al. | 208/140 |
| 4,578,370 | 3/1986 | Greenwood | 502/37 |
| 4,621,069 | 11/1986 | Ganguli | 502/45 |
| 4,647,549 | 3/1987 | Greenwood | 502/37 |
| 4,687,637 | 8/1987 | Greenwood | 422/62 |
| 4,701,429 | 10/1987 | Greenwood | 502/37 |
| 4,981,575 | 1/1991 | DeBonneville | 208/64 |
| 5,001,095 * | 3/1991 | Sechrist | 502/41 |
| 5,151,392 | 9/1992 | Fettis et al. | 502/37 |
| 5,227,566 | 7/1993 | Cottrell et al. | 585/660 |
| 5,336,834 | 8/1994 | Zarchy et al. | 585/737 |
| 5,376,607 | 12/1994 | Sechrist | 502/48 |
| 5,837,636 * | 11/1998 | Sechrist et al. | 502/41 |

OTHER PUBLICATIONS

Decker, W.H. and David Stewart "Cat Reforming With In–Place Regeneration", in: *The Oil and Gas Journal* Jul. 4, 1955; pp. 80–84.

Franck, J.P. and G. Martino "Deactivation and Regeneration of Catalytic–Reforming Catalysts" in: *Progress in Catalyst Deactivation* (The Hague, The Netherlands; Martinus Nojhoff Publishers 1982), pp. 355–397, editor: J.L. Figueiredo; TP156.C35N37.

Wonchala, E.P. and J.R. Wynnyckyj The Phenomenon of Thermal Channelling in Countercurrent Gas–Solid Heat Exchangers, in: *The Canadian Journal of Chemical Engineering,* vol. 65, (ct. 1987) pp. 736–743.

* cited by examiner

*Primary Examiner*—Bekir L. Yildirim
(74) *Attorney, Agent, or Firm*—John G. Tolomei; John F. Spears, Jr.; Michael A. Moore

(57) ABSTRACT

A method and apparatus are disclosed for removing water from a recycle gas stream in a catalyst regeneration process. A recycle gas stream contacts catalyst and the catalyst sorbs water from the recycle gas. Some of the now-dried recycle gas recirculates to the regeneration process, thereby decreasing the water content in the regeneration process. The catalyst containing sorbed water passes to a desorption zone, where water is desorbed from the catalyst and the desorbed water is rejected from the process. This method and apparatus are useful for extending the life of catalyst in catalytic hydrocarbon processes that employ continuous or semi-continuos catalyst regeneration zones.

10 Claims, 2 Drawing Sheets

46
40
42
44
18
20
66
54
52
64
56
77
76
80
58
62
60
78
74
72
92
84
79
82
22
75
73
68
46
70
86
88
98
90
94
94
100
40
96
93
95
104
18
97
178
106
114
102
110
69
68
112
108
67
71
116
118
120
121
122
124
136
126
138
140
136
134
128
139
130
131
147
148
146
158
149
145
150
144
132
178
143
142
154
141
162
156
164
152
160
168
176
172
166
174
170
18
24
26
46
28
30
38
12
10
32
14
36
34
16

46
40
202
204
208
210
204
200
206
212
214
218
216
230
222
220
224
246
244
242
236
240
247
248
236
234
248
252
250
232
228
226
254
260
248
238
275
284
286
256
270
268
266
264
278
279
280
262
282
276
274
256
288
285
290
258
174

APPARATUS FOR CONTROLLING MOISTURE IN A CATALYST REGENERATION PROCESS

CROSS-REFERENCE TO RELATED APPLICATIONS

This application is a division of U.S. application Ser. No. 09/158,160, filed Sep. 22, 1998 U.S. Pat. No. 6,123,833.

FIELD OF THE INVENTION

This invention relates to the art of catalytic conversion of hydrocarbons to useful hydrocarbon products. More specifically, it relates to the regenerating of spent hydrocarbon conversion catalyst so that the catalyst can be reused in a hydrocarbon by conversion reaction.

BACKGROUND OF THE INVENTION

Catalytic processes for the conversion of hydrocarbons are well known and extensively used. Invariably the catalysts used in these processes become deactivated for one or more reasons. Where the accumulation of coke deposits causes the deactivation, regenerating of the catalyst to remove coke deposits restores the activity of the catalyst. Coke is normally removed from catalyst by contact of the coke-containing catalyst at high temperature with an oxygen-containing gas to combust and remove the coke in a regeneration process. These processes can be carried out in-situ or the catalyst may be removed from a vessel in which the hydrocarbon conversion takes place and transported to a separate regeneration zone for coke removal. Arrangements for continuously or semicontinuously removing catalyst particles from a reaction zone and for coke removal in a regeneration zone are well known.

In order to combust coke in a typical regeneration zone, a recycle gas is continuously circulated to a combustion section and a flue gas containing by-products of coke combustion, oxygen and water is continually withdrawn. Coke combustion is controlled by recycling a low oxygen concentration gas into contact with the coke-containing catalyst particles. Thus, the flue gas/recycle gas is continuously circulated through the catalyst particles. A small stream of make-up gas is added to the recycle gas to replace oxygen consumed in the combustion of coke and a small amount of flue gas is vented off to allow for the addition of the make-up gas. The steady addition of make-up gas and the venting of flue gas establishes a steady state condition that produces a nearly constant concentration of water and oxygen in the recycle gas and the flue gas.

In a continuous or semi-continuous regeneration process, coke-laden particles are at least periodically added and withdrawn from a bed of catalyst in which the coke is combusted. Regions of intense burning that extend through portions of the catalyst bed develop as the coke is combusted. One problem associated with localized regions of intense coke combustion is catalyst deactivation. The combination of temperature, water vapor, and exposure time determines the useful life of the catalyst. Exposure of high surface area catalyst to high temperatures for prolonged periods of time will create a more amorphous material having a decreased surface area which in turn lowers the activity of the catalyst until it reaches a level where it is considered deactivated. Deactivation of this type is permanent, thereby rendering the catalyst unusable. When moisture is present—water is a by-product of the coke combustion—the deactivating effects of high temperature exposure are compounded.

SUMMARY OF THE INVENTION

The removal of moisture from high temperature catalytic processes where water is present as a by-product can produce geometric increases in the life of the catalyst that is employed in the process. In order to take advantage of this extended catalyst life, a moisture removal method that can be readily integrated into existing catalytic processes without large capital expenditures or greatly increased complexity for the system is provided. Thus, this invention is in one of its broad aspects a method of controlling the water content in a catalytic process by making inexpensive alterations to the arrangement and operation of the catalytic process. In addition, this invention is an apparatus for controlling the water content in the water-generation section of a catalyst regeneration vessel. This invention is broadly applicable to any catalytic process that employs a water-containing recycle gas stream that contacts catalyst that can sorb water and from which water can be desorbed. It is believed, however, that this invention is most applicable to those sections of typical catalyst regeneration zones that operate at high temperature and employ a water-containing recycle gas stream. Such regeneration sections include, but are not limited to, coke combustion sections, metal redispersion sections, and rehalogenating sections.

It has been discovered that the catalyst particles themselves, rather than a separate sorbent, can selectively sorb the water from the flue gas/recycle gas stream of the combustion section of a regeneration zone, thereby dramatically decreasing the water content of the flue gas/recycle gas. Unlike conventional methods of drying a flue gas/recycle gas stream by adsorbing water onto a separate adsorbent, this invention uses the catalyst particles entering the regeneration zone to capture and reject water from the regeneration zone. In order to take advantage of this property of these -catalysts to sorb water from the flue gas/recycle gas, a water sorption step and a water desorption step that can be readily integrated into existing regeneration processes without employing a separate sorbent is provided. This invention selectively sorbs water from the flue gas/recycle gas on catalyst particles and subsequently selectively desorbs water from catalyst particles. Both steps can occur prior to, or subsequent to, the actual regeneration of the catalyst particles in the regeneration zone. This invention is particularly applicable to regeneration zones that combust coke from coked, alumina particles, especially spent naphtha reforming catalysts and spent paraffin dehydrogenation catalysts.

In this invention, a sorption and desorption arrangement in combination with the regeneration zone of a catalytic hydrocarbon conversion process removes water that would otherwise remain in the process. The operating conditions of the sorption zone can be selected independently of those of the regeneration zone in order to maximize the selective sorption of water from the flue gas/recycle gas, while minimizing the sorption of components besides water that are present in the flue gas/recycle gas. In addition, the operating conditions of the desorption zone can be selected independently of the operating conditions of the sorption zone to maximize the selective desorption of water and to minimize the desorption of components besides water that may happen to have been sorbed on the catalyst particles in the sorption zone. Venting of the desorption zone outlet gas with its high water content decreases the amount of water in the flue gas/recycle gas. In this way, the overall equilibrium concentration of water in the flue gas/recycle gas is kept at a low level.

It has also been recognized that, even though unregenerated and regenerated catalyst particles are like traditional sorbents in that they are capable of sorbing up to, say, only about from 2 to 3 percent of their weight in water from a flue gas/recycle gas that contains hydrogen chloride and/or chlorine, a process that uses the catalyst particles entering or leaving the regeneration -zone to sorb water from the flue gas/recycle gas stream can nevertheless be useful because of the large quantity of catalyst available for sorption. Accordingly, in one of its embodiments, this invention is a process in which spent catalyst that is about to be regenerated is not passed to the regeneration zone but instead is first passed to a sorption zone. In the sorption zone, the spent catalyst particles sorb water from the flue gas/recycle gas. In part because the regeneration flue gas/recycle gas has a high content of hydrogen chloride and chlorine, the spent catalyst sorbs up to, say, only about from 2 to 3 percent of its weight in water. The spent catalyst, having sorbed what water it can, is withdrawn from the sorption zone and is then passed to the desorption zone. Whatever water the spent catalyst sorbed in the sorption zone is desorbed in the desorption zone and vented from the process, thereby decreasing the water in the regeneration zone. Meanwhile, the sorption zone is replenished with a continual stream of spent catalyst, which is capable of being supplied to the sorption zone at a rate that is more than sufficient to compensate for the fact that the spent catalyst sorbs only up to about 2 to 3 percent of its weight in water. In short, in this invention the abundant quantity of available spent catalyst for sorption more than compensates for what persons skilled in the art would consider a small and uneconomical amount of water sorbed by the spent catalyst.

In combustion sections of regeneration processes as currently commercially practiced, the flue gas/recycle gas will have a moisture content of about 5 to 6 mol-%. By practicing this invention, in which a portion of the water is removed from the flue gas/recycle gas, the moisture content in the flue gas/recycle gas may be decreased to about 1 to 2 mol-%. Thus, the method of this invention can significantly reduce the moisture content in the combustion section of a regeneration zone, thereby improving catalyst life and performance.

A basic requirement for using this invention is a catalyst that has sorption capacity for water. This invention is not limited to any particular type of catalyst; any catalyst with the necessary capacity may be used. The catalyst will recover more than 5%, preferably more than 50%, and more preferably more than 90% of the water in the flue gas/recycle gas, or in the portion of the flue gas/recycle gas, that is passed through the sorption zone. The typical catalyst for use in this invention comprise alumina, including alumina, activated aluminas, silica alumina, molecular sieves, and alumino-silicate clays such as kaolin, attapulgite, sepiolite, polygarskite, bentonite, and montmorillonite, particularly when the clays have not been washed by acid to remove substantial quantities of alumina. Reference is made to Zeolitic Molecular Sieves, by Donald W. Breck (John Wiley & Sons, 1974), which describes the use and selection of zeolite adsorbents and which is incorporated herein by reference.

The sorption and removal capacity of the catalyst for the water must exist under a reasonable range of conditions. In theory, this requirement does not limit the scope of this invention in any significant way, because in principle the sorption and desorption conditions can be chosen independently of each other and of the regeneration conditions. Preferably, however, the process conditions of the flue gas/recycle gas will complement the sorption requirements of the catalyst. For example, it has been found that the sorption of water increases with an increase in pressure. Consequently, a preferred embodiment of this invention includes a high-pressure sorption zone where water is sorbed followed by a low-pressure desorption zone where water is desorbed.

Thus, this invention uses sorption and desorption steps or sections in a catalyst regeneration or particle treatment process or apparatus that result in the capture and rejection of water from the process. The process is compatible with a wide variety of catalyst regeneration sections for hydrocarbon conversion processes. This compatibility can minimize utility costs by operating at conditions that are compatible with the typical process conditions and existing process steps.

It is an object of this invention to improve processes for regenerating hydrocarbon conversion catalysts.

It is another object of this invention to remove water from recycle gas that is present during catalyst regeneration.

A further object of this invention is to decrease the costs that are incurred in the removal of water from catalyst regeneration processes.

In a broad embodiment, this invention is a method for removing water from a catalytic contacting process. Catalyst is contacted with a contacting stream comprising hydrogen or oxygen, water is formed, and a wet stream comprising water is produced. Before or after the contacting of catalyst with the contacting stream, catalyst is contacted with the wet stream and water is sorbed from the wet stream on catalyst, and a dry stream is produced. The contacting stream is formed from at least a portion of the dry stream. Water is desorbed from catalyst after the contacting of catalyst with the wet stream, and water is rejected from the process.

In a more specific embodiment, this invention is a method for decreasing the concentration of water in a regeneration zone of a catalyst regeneration process. At least a portion of a recycle stream comprising hydrogen or oxygen is passed to a regeneration zone containing catalyst particles. In the regeneration zone at regeneration conditions, catalyst particles are at least partially regenerated and water is produced. A flue stream comprising water is withdrawn from the regeneration zone. At least a portion of the flue stream is passed to a sorption zone containing catalyst particles. At least a portion of the water in the portion of the flue stream is sorbed on catalyst particles in the sorption zone at sorption conditions. The sorption of water on catalyst particles occurs before or after the at least partial regeneration. A sorption effluent stream is withdrawn from the sorption zone. At least a portion of the sorption effluent stream is combined with a make-up stream comprising hydrogen or oxygen to form the recycle stream. A desorption inlet stream is passed to a desorption zone containing catalyst particles having water sorbed thereon from the sorption. At least a portion of the water is desorbed from catalyst particles in the desorption zone at desorption conditions. A desorption outlet stream comprising water is withdrawn from the sorption zone. Catalyst particles are at least periodically moved through the sorption zone, the desorption zone, and the regeneration zone.

In another more specific embodiment, this invention is a process for the catalytic conversion of a hydrocarbon feedstock. A hydrocarbon feedstock is passed to a reaction zone, the feedstock is contacted with catalyst particles, and a hydrocarbon product is recovered. Deactivated catalyst particles are removed from the reaction zone. At least a portion of a recycle stream comprising hydrogen or oxygen is passed to a regeneration zone containing catalyst particles. In the regeneration zone at regeneration conditions, catalyst particles are at least partially regenerated and water is produced. A flue stream comprising water is withdrawn from the regeneration zone. At least a portion of the flue stream is passed to a sorption zone containing catalyst particles. In the sorption zone at sorption conditions, at least a portion of the water in the portion of the flue stream is sorbed on catalyst particles. A sorption effluent stream is withdrawn from the sorption zone. At least a portion of the sorption effluent stream is combined with a make-up stream comprising hydrogen or oxygen to form the recycle stream. A desorption inlet stream is passed to a desorption zone containing catalyst particles. In the desorption zone at desorption conditions, at least a portion of the water is desorbed from catalyst particles. A desorption outlet stream comprising water is withdrawn from the desorption zone. Catalyst particles are at least periodically moved through the sorption zone, the desorption zone, and the regeneration zone by withdrawing a regenerated catalyst stream comprising catalyst particles and hydrogen or oxygen from the regeneration zone, by passing catalyst particles from the desorption zone to the regeneration zone, by passing catalyst particles containing water from the sorption zone to the desorption zone, and by passing catalyst particles from the reaction zone to the sorption zone. At least a portion of the regenerated catalyst stream is passed to a purge zone, and at least partially regenerated catalyst particles are passed from the purge zone to the reaction zone. A purge inlet stream is passed to the purge zone at a rate that is sufficient to purge hydrogen or oxygen from the total void volume in the purge zone, and a purge outlet stream comprising hydrogen or oxygen is withdrawn from the purge zone. The desorption inlet stream is formed from at least a portion of the purge outlet stream.

In yet another embodiment, this invention is an apparatus for regenerating catalyst particles. A first vessel section defines a water-generation section. A means are provided for adding catalyst particles to the water-generation section and also for contacting catalyst particles with a fresh regeneration gas in the water-generation section in order to at least partially regenerate catalyst particles and also to produce a water-enriched regeneration gas. Means are provided for withdrawing catalyst particles from the water-generation section. A second vessel section defines a water-sorption section. Means are provided for receiving the water-enriched regeneration gas from the water-generation section in the water sorption section. Means are also provided for adding catalyst particles to the water-sorption section and for contacting catalyst particles with the water-enriched regeneration gas in the water-sorption section in order to at least partially sorb water on catalyst particles and also to produce a water-depleted regeneration gas. Means are provided for passing the water-depleted regeneration gas from the water-sorption section to the water-generation section in order to produce at least a portion of the fresh regeneration gas. A third vessel section defines a water-desorption section. Means are provided for receiving catalyst particles from the water-sorption section and also for contacting catalyst particles with a desorption gas in the water-desorption section in order to at least partially desorb water from catalyst particles and also to produce a vent gas. Means are provided for collecting and withdrawing the vent gas from the water-desorption section. Means are provided for withdrawing catalyst particles from the water-desorption section.

INFORMATION DISCLOSURE

U.S. Pat. No. 3,652,231 (Greenwood et al.) shows a regeneration apparatus in which a constant-width movable bed of catalyst is utilized. The '231 patent also describes a continuous catalyst regeneration process which is used in conjunction with catalytic reforming of hydrocarbons. U.S. Pat. No. 3,647,680 (Greenwood et al.) and U.S. Pat. No. 3,692,496 (Greenwood et al.) also deal with regeneration of reforming catalyst. The teachings of patents ('231, '680, and '496) are hereby incorporated in full into this patent application.

U.S. Pat. No. 5,376,607 (Sechrist et al.) discloses a process for controlling moisture in a flue gas/recycle gas of a combustion section of a regeneration zone. The teachings of '607 are hereby incorporated in full into this patent application.

U.S. Pat. No. 5,336,834 (Zarchy et al.) discloses an adsorption zone in combination with a catalytic hydrocarbon conversion process that keeps chlorine-containing compounds in the reaction zone and prevents contamination of product streams with chlorine-containing compounds.

U.S. Pat. No. 4,218,338 (Huin et al.) discloses a process for regenerating a hydrocarbon conversion catalyst wherein the gas discharged from the regeneration zone is cooled, subjected to double washing, dried, compressed, heated, and reused in the regeneration zone.

Temperature control and chloride management during regeneration of fixed beds of catalyst are described in the article entitled "Cat Reforming with In-Place Regeneration," written by W. H. Decker et al., and published in the Jul. 4, 1955, issue of The Oil and Gas Journal beginning at page 80, and in the discussion at pages 355–397 in the book entitled *Progress in Catalyst Deactivation,* edited by J. L. Figueiredo, and published by Martinus Nijhoff Publishers in Boston, Mass. in 1982.

U.S. Pat. No. 4,647,549 (Greenwood) discloses a regeneration method and apparatus in which an air stream is introduced into the bottom of a regeneration vessel and is heated by exchange of heat with catalyst, thereby effecting cooling of the catalyst. Before passing into a drying zone and then into a combustion zone, the air stream is heated further by heating means located in the regeneration vessel.

Thermal flow rates and moving beds are described in the article by E. P. Wonchala and J. R. Wynnyckyj entitled, "The Phenomenon of Thermal Channelling in Countercurrent Gas-Solid Heat Exchangers," published in *The Canadian Joumal of Chemical Engineering,* Volume 65, October 1987, pages 736–743, the teachings of which are incorporated herein by reference.

U.S. Pat. No. 4,621,069 issued to Ganguli discloses a catalyst regeneration process in which hot regenerated catalyst is cooled by indirect heat exchange.

U.S. Pat. Nos. 4,687,637 and 4,701,429 issued to Greenwood disclose a continuous regeneration apparatus and process in which the amount of air supplied to a combustion zone is adjusted independently of the air supplied to a drying zone.

Catalyst regeneration processes in which moving beds of catalyst are contacted with oxygen or hydrogen are described in U.S. Pat. No. 4,172,027 (Ham et al.); U.S. Pat. No. 4,233,268 (Boret et al.); U.S. Pat. No. 4,578,370 (Greenwood); U.S. Pat. No. 4,981,575 (De Bonneville); U.S. Pat. No. 5,151,392 (Fettis et al.); and U.S. Pat. No. 5,227,566 (Cottrell et al.).

DETAILED DESCRIPTION OF THE INVENTION

Figure 1:
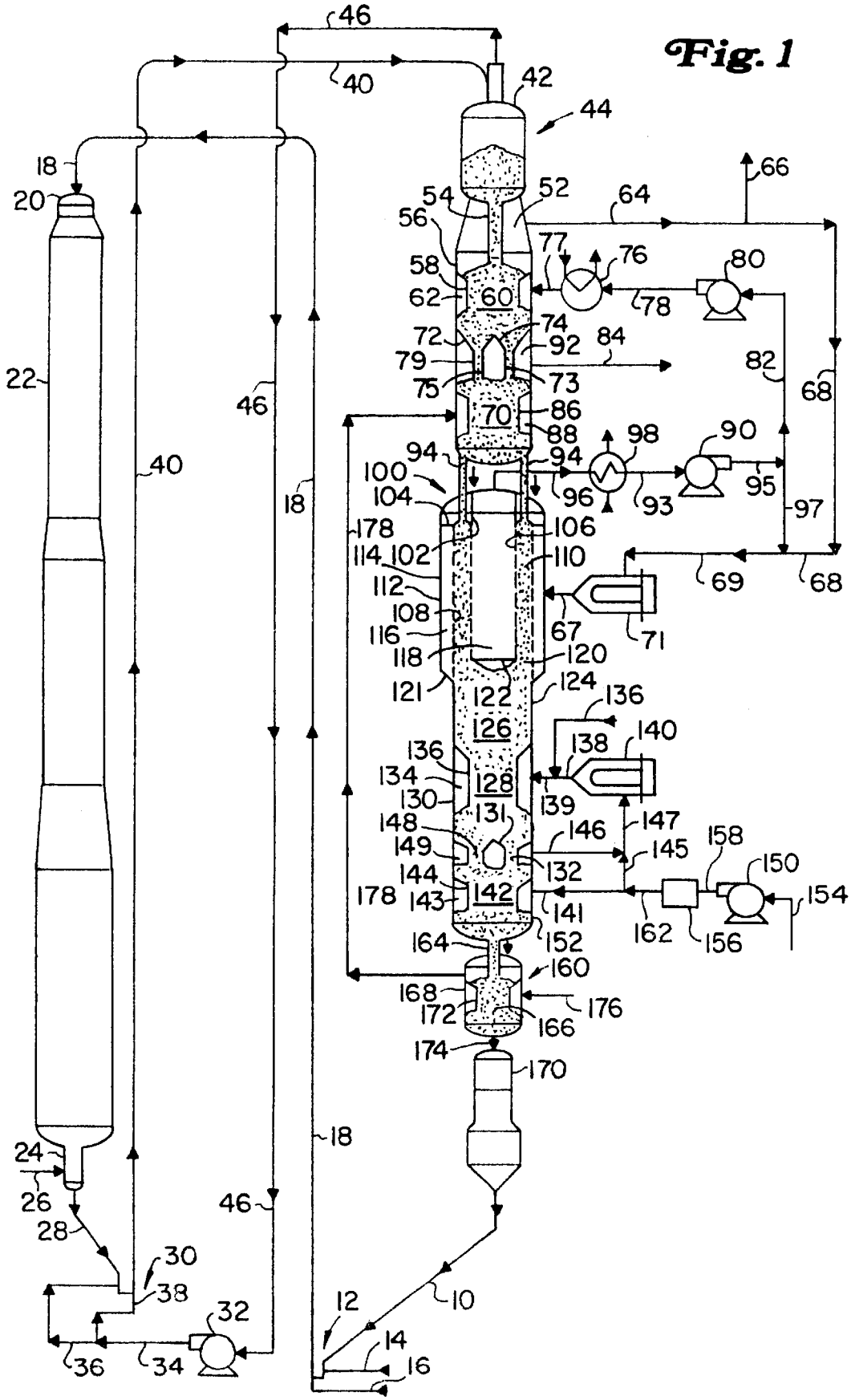
FIG. 1 is a schematic illustration of an embodiment of this invention.

In its broadest terms, this invention can be used to remove water in any process that employs a water-containing recycle stream that contacts catalyst that can sorb water and from which water can be removed. One such application that requires decreasing the water concentration is the removal of coke from catalyst particles in a regeneration zone. It is not necessary, however, to limit this invention to coke combustion, to catalyst regeneration, or even to processes that consume oxygen and produce by-product water, because this invention may be generally applicable to other processes that use a water-containing recycle stream to contact catalyst which can sorb and desorb water.

Generally, the catalyst that can sorb and desorb water comprise inorganic oxides, preferably alumina. The alumina may be present alone or it may be combined with a porous inorganic oxide diluent as a binder material. Alumina having a high surface area is preferred. The alumina may be present in any of its solid phases, but gamma-alumina is preferred. The alumina may also be present as a chemical combination with other elements such as silica-aluminas or alumino-silicate clays. Because many hydrocarbon conversion catalysts comprise alumina, the hydrocarbon conversion catalysts that may be used with this invention are numerous. They include catalysts for reforming, dehydrogenation, isomerization, alkylation, transalkylation, and other catalytic conversion processes. These catalysts are well known. See, for example, U.S. Pat. No. 2,479,110 and 5,128,300 (reforming); U.S. Pat. No. 4,430,517 and 4,886,928 (dehydrogenation); U.S. Pat. No. 2,999,074 and 5,017,541 (isomerization); U.S. Pat. No. 5,310,713 and 5,391,527 (alkylation); and U.S. Pat. No. 3,410,921 (transalkylation). The teachings of these patents are incorporated herein by reference.

It is believed that the most widely-practiced processes that produce recycle streams containing water and that also employ alumina-containing particles are hydrocarbon conversion processes. The most widely practiced hydrocarbon conversion process to which the present invention is applicable is catalytic reforming.

Catalytic reforming is a well-established hydrocarbon conversion process employed in the petroleum refining industry for improving the octane quality of hydrocarbon feedstocks, the primary product of reforming being motor gasoline. The art of catalytic reforming is well known and does not require detailed description herein. The discussion of this invention in the context of a catalytic reforming reaction system is not intended to limit the scope of the invention as set forth in the claims.

Briefly, in catalytic reforming, a feedstock is admixed with a recycle stream comprising hydrogen and contacted with catalyst in a reaction zone. The usual feedstock for catalytic reforming is a petroleum fraction known as naphtha and having an initial boiling point of about 180° F. (82° C.) and an end boiling point of about 40° F. (204° C.). The catalytic reforming process is particularly applicable to the treatment of straight run gasolines comprised of relatively large concentrations of naphthenic and substantially straight chain paraffinic hydrocarbons, which are subject to aromatization through dehydrogenation and/or cyclization reactions.

Reforming may be defined as the total effect produced by dehydrogenation of cyclohexanes and dehydroisomerization of alkylcyclopentanes to yield aromatics, dehydrogenation of paraffins to yield olefins, dehydrocyclization of paraffins and olefins to yield aromatics, isomerization of n-paraffins, isomerization of alkylcycloparaffins to yield cyclohexanes, isomerization of substituted aromatics, and hydrocracking of paraffins. Further information on reforming processes may be found in, for example, U.S. Pat. No. 4,119,526 (Peters et al.); U.S. Pat. No. 4,409,095 (Peters); and U.S. Pat. No. 4,440,626 (Winter et al.).

A catalytic reforming reaction is normally effected in the presence of catalyst particles comprised of one or more Group VII noble metals (e.g., platinum, iridium, rhodium, palladium) and a halogen combined with a porous carrier, such as a refractory inorganic oxide. The halogen is normally chloride. Alumina is a commonly used carrier. The preferred alumina materials are known as the gamma, eta, and theta alumina, with gamma and eta alumina giving the best results. An important property related to the performance of the catalyst is the surface area of the carrier. Preferably, the carrier will have a surface area of from 100 to about 500 $m^2/g$. It has been discovered that the greater the surface area of the carrier, the greater is the capacity of the catalyst to sorb chloride according to the method of this invention. The particles are usually spheroidal and have a diameter of from about 1/16th to about 1/8th inch (1.5–3.1 mm), though they may be as large as 1/4th inch (6.35 mm). In a particular regenerator, however, it is desirable to use catalyst particles which fall in a relatively narrow size range. A preferred catalyst particle diameter is 1/16th inch (3.1 mm).

Although the catalysts that may be used with this invention may contain halogens such as fluorine, bromine, iodine, as previously mentioned reforming catalysts preferably contain chlorine. In order to clarify the discussion that follows as it relates to the use of this invention with chlorine-containing catalysts or particles, it is useful at this point to define the following terms. The term "chloro-species" herein refers to any molecule that contains chlorine, other than the chloride component or chloride entities that exist on the particles. For example, chloro-species include chlorine, hydrogen chloride, chlorinated hydrocarbons with or without oxygen, and compounds containing chlorine and a metal. The term "chlorine" herein refers to elemental chlorine, which exists as a diatomic molecule at standard conditions. The term "chloride" when used alone herein refers to the chloride component or chloride entities that exist on the particles. Chloride on the particles is believed to exist as various compounds depending on the composition and conditions of the particles. For example, if the particles contain alumina then the chloride may exist on the particles as an entity consisting of chlorine, oxygen, hydrogen, and aluminum atoms.

During the course of a reforming reaction, catalyst particles become deactivated as a result of mechanisms such as the deposition of coke on the particles; that is, after a period of time in use, the ability of catalyst particles to promote reforming reactions decreases to the point that the catalyst is no longer useful. The catalyst must be regenerated before it can be reused in a reforming process.

The present invention is applicable to a reforming process with fixed- or moving-bed reaction zones and at least one moving-bed regeneration zone. But the preferred form of a reforming process is a moving-bed reaction zone and a moving-bed regeneration zone. Catalyst is fed to a reaction zone, which may be comprised of several subzones, and the catalyst flows through the zone by gravity. Catalyst is withdrawn from the bottom of the reaction zone and transported to a regeneration zone where a hereinafter described multi-step regeneration process is used to regenerate the catalyst to restore its full reaction promoting ability. Catalyst flows by gravity through the various regeneration steps and then is withdrawn from the regeneration zone and furnished to the reaction zone. Catalyst that is withdrawn from the regeneration zone is termed regenerated catalyst. Movement of catalyst through the zones is often referred to as continuous though, in practice, it is semicontinuous. By semicontinuous movement is meant the repeated transfer of relatively small amounts of catalyst at closely spaced points in time. For example, one batch per minute may be withdrawn from the bottom of a reaction zone and withdrawal may take one-half minute, that is, catalyst will flow for one-half minute. If the inventory in the reaction zone is large, the catalyst bed may be considered to be continuously moving. A moving bed system has the advantage of maintaining production while the catalyst is removed or replaced.

Catalyst regeneration can comprise a number of steps, and the preferred combination, sequence, and operating conditions of the regeneration steps depend on many factors. These factors include the select chemical and physical properties of the particular catalyst that is being regenerated, the extent and mechanism of the deactivation of the catalyst, the desired reactions to be catalyzed by the catalyst, the desired products to be produced by those reactions, and the reaction conditions at which those products will be produced. Three steps that are commonly found in catalyst regeneration procedures are coke burning, oxidation, and reduction. Coke burning removes coke deposits by contacting with oxygen, oxidation oxidizes the catalytic metal by contacting with oxygen, and reduction reduces the catalytic metal by contacting with hydrogen. Because of the presence of oxygen and hydrogen during each of these steps, water can be produced or regenerated as the regeneration step proceeds and consequently water can be present in the regeneration effluent stream.

When using the method of this invention in a continuous or semicontinuous catalyst regeneration zone, the catalyst is contacted with a hot gas stream containing hydrogen or oxygen, which is known in reforming processes as recycle gas and which is circulated to the zone, and a flue gas that contains water is withdrawn from the zone. For coke combustion, metal oxidation, and metal redispersion the recycle gas typically contains oxygen, and for metal reduction the recycle gas typically contains hydrogen.

In metal reduction, hydrogen for the reduction of the metal enters what is called a reduction section of the regeneration zone in a hydrogen-rich reduction gas. By hydrogen-rich, it is meant a gas having a concentration of hydrogen of greater than 50 mol-%. The reduction gas may have a hydrogen concentration of 5–100 mol-%, and preferably 85–100 mol-%. The hydrogen-rich reduction gas will typically have a hydrogen concentration of about 85 mol-%, with the balance being $C_1$–$C_5$ hydrocarbons. The reduction gas will contact the catalyst at a temperature of generally from about 250° F. (121° C.) to about 1050° F. (566° C.), and more commonly from about 250° F. (121° C.) to about 700° F. (371° C.). The reduction pressure is maintained typically in the range of 50–200 psi(g) (3.5–14 kg/cm$^2$(g)).

It is believed, however, that the most widely-practiced oxygen-contacting process to which this invention is applicable is coke combustion. Therefore, the description of the invention contained herein will in large part be in reference to its application to a coke combustion section. It is not intended that such description limit the scope of the invention as set forth in the claims.

In coke combustion, oxygen for the combustion of coke enters what is called a combustion section of the regeneration zone in the recycle gas. The recycle gas stream contains a low concentration of oxygen of typically from 0.5 to 1.5 vol-%, and coke which accumulated on surfaces of the catalyst to typically 0.2 to 5.0 wt-% of the catalyst weight while the catalyst was in the hydrocarbon conversion reaction zone is removed by combustion. Catalyst from the reaction zone is referred to herein as spent catalyst or as deactivated catalyst. Coke is comprised primarily of carbon but is also comprised of a relatively small quantity of hydrogen, generally from 0.5 to 10 wt-% of the coke. The mechanism of coke removal is oxidation to carbon monoxide, carbon dioxide, and water. The coke content of spent catalyst may be as much as 20% by weight of the catalyst weight, but from 5 to 7% by weight is a more typical amount. Within the combustion section, coke is usually oxidized at temperatures ranging from 900 to 1000° F. (482 to 538° C.), but temperatures in localized regions may reach 1100° F. (593° C.) or more. Because of these high temperatures and also because of high water concentrations, catalyst chloride is quite readily removed from the catalyst during coke combustion. The presence of the chloro-species in the combustion recycle gas can help to prevent chloride from being stripped from the catalyst, and can also help prevent the catalyst metal from agglomerating. Coke combustion consumes oxygen, so a small stream of make-up gas is added to the combustion recycle gas to replace the consumed oxygen, and a small amount of flue gas is vented off to allow for the addition of the make-up gas. The steady addition of make-up gas and the venting of flue gas establishes a steady state condition that produces a nearly constant concentration of water, as well as of oxygen and chloro-species, in the combustion recycle gas and in the flue gas. The operating variables that affect the water concentration of the combustion recycle gas are described in U.S. Pat. No. 5,001,095 (Sechrist) and U.S. Pat. No. 5,376,607 (Sechrist), the teachings of which are incorporated herein by reference. Catalyst that is withdrawn from the combustion zone is referred to herein as combusted catalyst. The coke content of the combusted catalyst may be 0.01% by weight of the catalyst weight or less, but generally it is approximately 0.2% by weight or less.

Generally, the make-up gas to the combustion section of a reforming catalyst regeneration zone comprises air and most of the oxygen in the make-up air is consumed in the combustion of coke. Therefore, the flue gas or recycle gas generally contains from 70 to 80 mol-% nitrogen, from 10 to 20 mol-% carbon oxides, which is mainly carbon dioxide with trace amounts of carbon monoxide, and from 0.2 to 2.0 mol-% oxygen.

Oxygen might, however, not be present in the flue gas stream if all of the oxygen is consumed in the combustion of coke in, for example, a multistage combustion zone. The concentration of hydrogen chloride in the flue gas or recycle gas is generally from 500 to 10000 mol-ppm, and usually from 1000 to 5000 mol-ppm. The concentration of chlorine in the flue gas or recycle gas is generally from 10 to 500 mol-ppm, and preferably from 25 to 100 mol-ppm. In general, lower concentrations of chloro-species are preferred because chloro-species compete with water for sorption on the catalyst particles in the sorption zone. The flue gas or recycle gas may also contain trace amounts of other volatile chloro-species such as chlorinated hydrocarbons and chlorinated metals. Sulfur, in the form of sulfur oxides such as sulfur dioxide and sulfur trioxide, is preferably minimized in the flue gas or recycle gas. While nitrogen, carbon oxides, oxygen, hydrogen chloride, and chlorine are typical but not required components of the gas stream that is passed to the sorption zone, the gas stream must contain water. The gas stream that is passed to the sorption zone has a higher concentration of water than the stream that is removed from the sorption zone, and therefore the former is sometimes referred to herein as the water-enriched stream while the latter is sometimes referred to herein as the water-depleted stream. The concentration of water in the gas stream to the sorption zone is usually more than 0.5 vol-% (5000 vol-ppm), generally from 0.5 to 20 vol-%, and preferably from 2 to 5 vol-%.

For reduction of a reforming catalyst, the recycle gas generally contains not only hydrogen but also water as a by-product of reducing the catalytic metal. The concentrations of hydrogen and water in the flue gas or recycle gas can vary over a wide range depending on a number of factors, including the composition of the make-up gas, the make-up gas rate, the reduction conditions, and the chemical and physical properties of the catalytic metal on the catalyst. For example, when the molar ratio of recycle gas hydrogen per catalytic metal is in excess of the amount necessary to reduce the catalytic metal and the make-up gas rate is low or nil, then the concentration of water in the recycle gas or the flue gas can accumulate to substantial concentrations as more and more of the catalyst metal is reduced. In this case, whether or not a steady state concentration of water is attained will depend on the rate and the process by which the by-product water is removed from the flue gas. In prior art processes, the water is removed by cooling the flue gas, condensing some of the water in the flue gas, and separating the liquid water condensate from the remaining uncondensed flue gas. Thus, the water concentration in the recycle gas depends on the extent to which the recycle gas and liquid water are separated, and in the case of ideal gas-liquid separation on the equilibrium concentration of water in the recycle gas at the gas-liquid separation conditions. In prior art processes, the concentration of water in the flue gas or the recycle gas is generally more than 0.003 vol-%, typically more than 0.1 vol-%, and usually more than 1 vol-%, and in some circumstances the concentration of water may be between 3 and 20 vol-%, or even higher. The flue gas or recycle gas during reduction may also contain chloro-species, such as hydrogen chloride.

When using the method of this invention, a portion of the flue gas/recycle gas is passed to a sorption zone which uses spent catalyst particles, which have not yet passed to the combustion zone, to remove water from the flue gas. Unlike prior art processes, the method of this invention does not use a separate adsorbent to adsorb the water from the flue gas/recycle gas, but instead this invention uses the catalyst particles themselves for the sorption. The sorption zone can be any of the well-known arrangements for contacting solid particles with a gas stream and sorbing components from the gas stream onto the solid particles. The sorption zone may comprise a moving catalyst bed, in which case the direction of the gas flow is preferably countercurrent relative to the direction of movement of the catalyst. The direction of gas flow can, however, be cocurrent, crosscurrent, or a combination of countercurrent, cocurrent, and crosscurrent. The distributor for the gas flow to the catalyst bed may be of any suitable type, but preferably it is an annular distributor of the type disclosed in U.S. Pat. No. 4,662,081 (Greenwood), U.S. Pat. No. 4,665,632 (Greenwood), and U.S. Pat. No. 5,397,458 (Micklich, et al.). The teachings of these references regarding annular distributors are incorporated herein by reference.

The sorption zone is operated at sorption conditions effective to sorb at least a portion of the water from the flue gas/recycle gas. The water content of the spent catalyst entering the sorption zone may be as much as 0.5% by weight of the catalyst weight, but from 0.01 to 0.1% is a more typical amount. Although the spent catalyst particles that sorb water in the sorption zone have a higher coke content than fresh catalyst particles, it has been discovered that spent catalyst particles have surprisingly similar capabilities for chloride retention as fresh catalyst particles. Accordingly, it is believed that spent catalyst particles have similar capabilities for water retention as partially regenerated catalyst particles (e.g., catalyst particles after coke combustion). Thus, in order for sorption of water to occur in the sorption zone the operating conditions in the sorption zone must be more favorable than the operating conditions of the water-generating or water-producing zone (e.g., combustion zone, oxidation zone, or reduction zone) for sorption of water. Generally, these more favorable conditions in the sorption zone include a reduced temperature or an increased pressure of the gas that contacts the catalyst. Preferably, the sorption zone operates at a reduced temperature relative to the water-generating zone.

A cooler temperature in the sorption zone relative to the water-generating zone can achieved in a variety of ways. Although the catalyst can be cooled prior to entering the sorption zone or the sorption zone may be equipped with cooling means to cool the flue gas/recycle gas or catalyst within the sorption zone, the preferred method of maintaining a cooler temperature in the sorption zone is by cooling the flue gas/recycle gas after leaving the water-generating zone and prior to entering the sorption zone. The flue gas/recycle gas can be cooled by any suitable cooler, but an air-cooled shell-and-tube heat exchanger having the flue gas/recycle gas within the tubes is preferred. The temperature of the flue gas/recycle gas is generally from 0 to 900° F. (−18 to 482° C.) and preferably from 50 to 250° F. (10 to 121° C.). In adapting this invention to a regeneration process that already uses a prior art water removal process and that already has an existing cooler for cooling the flue gas/recycle gas prior to water removal, that existing cooler can be used to cool the flue gas/recycle gas. In order to maximize heat integration and the energy efficiency of the sorption zone, the flue gas/recycle gas can be heat-exchanged with the water-containing catalyst particles that exit the sorption zone. The temperature in the sorption zone and in any coolers if present is preferably maintained above the dew point temperature of the gas in order to minimize the possibility of condensing corrosive acidic liquid in any equipment. The temperature of the spent catalyst particles entering the sorption zone or the temperature of the sorption zone is generally from 0 to 900° F. (−18 to 482° C.) and preferably from 50 to 250° F. (10 to 121° C.)

A higher pressure in the sorption zone relative to the water-generating zone, if desired, can be achieved by numerous methods, the simplest being a blower or compressor located in the conduit for the flue gas/recycle gas between the water-generating zone and the sorption zone. The pressure of the sorption zone is generally from 0 to 500 psi (0 to 3447 kPa) absolute and preferably from 15 to 100 psi (103 to 689 kPa). The pressure of the sorption zone can be from 5 to 100 psi (34 to 689 kPa) higher than the pressure of the water-generating zone. Embodiments of this invention where the pressure of the sorption zone is higher than the pressure of the water-generating regeneration zone are especially adaptable to hydrocarbon processing units with continuous catalyst regeneration sections where the pressure of the last reaction zone through which the catalyst passes prior to regeneration is higher than the pressure of the regeneration section. In these embodiments, the pressure of the sorption zone can be maintained approximately at the pressure of the last reaction zone, and the pressure of the chlorided catalyst is decreased to the pressure of the water-producing regeneration zone after sorption by conventional means such as a valved or valveless lock hopper.

The ability of the catalyst to sorb water in the sorption zone can also be enhanced by drying the spent catalyst particles prior to entering the sorption zone. Water that is already sorbed on the spent catalyst particles before the particles enter the zone occupies sites that would otherwise be available for sorption of water. The water content of the spent catalyst particles is generally less than 1 wt.-% and typically less than 0.1 wt.-%. Therefore, water content is usually not a significant factor nor an important variable for water sorption.

Sorption conditions also include a gas hourly space velocity of generally from 5 to 20000 $hr^{-1}$ and preferably from 10 to 1000 $hr^{-1}$, and a particle residence time of generally from 0.1 to 10 hours and preferably from 2 to 4 hours. Persons skilled in the art are aware that the temperature within the sorption zone is influenced not only by the temperatures but also by the thermal mass flow rates of the gas and catalyst particles through the sorption zone. Thus, in order to achieve a desired sorption temperature, it may be necessary to adjust the flow rates of gas and catalyst particles relative to each other.

In order to take advantage of the property of these catalysts to sorb more water at higher pressures, one embodiment of this invention includes operating the sorption zone at a pressure that is higher than the pressure of the desorption zone, as well as higher than the pressure of the regeneration zone. A higher pressure may be compatible with some prior art hydrocarbon catalyst regeneration processes in which the catalyst is employed for hydrocarbon conversion at pressure that is higher than the pressure of the regeneration step. In these prior art processes, it is beneficial to perform the sorption of the water on the catalyst prior to decreasing the pressure of the particles for the desorption step and/or the regeneration step. This optimization not only maximizes the water sorption in the sorption zone but also water desorption in the desorption zone. Therefore, this invention may be adaptable to existing and prior art processes and achieve substantial benefits with a minimum of utility requirements and additional capital expenses.

Water-containing catalyst that exits the sorption zone passes to a desorption zone, where the water is desorbed from the catalyst. The method of desorption can be any suitable means, but the preferred method is contacting the catalyst with a hot, dry gas. The desorption gas can be any gas that does not have a deleterious effect on the catalyst. The desorption gas can comprise a portion of the effluent gas from the sorption zone, that is, a portion of what remains of the flue gas/recycle gas after some of its water has been removed in the sorption zone. Preferably the desorption gas is compatible with the water-generating or water-producing section. This means that any desorption gas that remains in the pore volume of the catalyst does not have an adverse effect on the operation of the water-generating section when the catalyst is passed from the desorption zone to the water-generating section. Otherwise, an additional purge step is required between the desorption zone and the water-generating section. Preferably the desorption gas comprises nitrogen.

The desorption zone can be any of the well-known arrangements for contacting solid particles with a gas stream and desorbing components from the gas stream onto the solid particles. Although the desorption zone can comprise a fixed catalyst bed or a fluidized catalyst bed, the preferred sorption zone comprises a moving catalyst bed. The direction of the gas flow is preferably countercurrent relative to the direction of movement of the catalyst, but the direction of gas flow can also be cocurrent, crosscurrent, or a combination of countercurrent, cocurrent, and crosscurrent. The distributor for the gas flow to the catalyst bed may be of any suitable type, but preferably it is an annular distributor.

The desorption zone is operated at desorption conditions effective to desorb at least a portion of the water from the catalyst. The water content of the catalyst entering the desorption zone may be as much as 5% by weight of the catalyst weight, but from 1 to 3% is a more typical amount. The water content of the catalyst exiting the desorption zone is generally from 0.1 to 3% by weight of the catalyst weight, and preferably from 0.5 to 1.5%.

The temperature of the desorption gas is generally from 150 to 900° F. (66 to 482° C.) and preferably from 300 to 500° F. (149 to 260° C.). The temperature of the spent catalyst particles entering the desorption zone is generally from 150 to 900° F. (66 to 482° C.) and preferably from 300 to 500° F. (149 to 260° C.). The temperature of the desorption zone is generally greater than the temperature of the sorption zone. The pressure of the desorption zone is generally from 0 to 500 psi (0 to 3447 kPa) absolute and preferably from 15 to 100 psi (103 to 689 kPa). The pressure of the desorption zone is generally from 5 to 100 psi (34 to 689 kPa) and preferably from 15 to 50 psi (103 to 344 kPa) lower than the pressure of the sorption zone. Desorption 2( conditions also include a gas hourly space velocity of generally from 5 to 20000 $hr^{-1}$ and preferably from 10 to 1000 $hr^{-1}$, and a particle residence time of generally from 0.1 to 10 hours and preferably from 2 to 4 hours. The temperature within the desorption zone is influenced not only by the temperatures but also by the thermal mass flow rates of the gas and catalyst particles through the desorption zone. Thus, in order to achieve a desired desorption temperature, it may be necessary to adjust the flow rates of gas and catalyst particles relative to each other.

FIG. 1 illustrates a reactor and regenerator system for a reforming reaction zone that uses the sorption system of this invention to remove water from the recycle gas stream of a regeneration zone. Starting with the movement of partially-regenerated catalyst, a lower conduit 10 supplies catalyst particles that have been oxidized but not reduced to a nonmechanical valve 12. A regulating fluid preferably comprising hydrogen enters valve 12 through a conduit 14 at a rate that regulates the transfer of catalyst particles through the valve 12 into a lift conduit 18. Nonmechanical valve 12 can take on forms such as L valves, J valves, and K valves. Nonmechanical valves are well known, and further information on the operation of such valves can be found in an article titled, "L Valves Characterized for Solid Flow," *Hydrocarbon Processing,* March 1978, beginning at page 149; in a text titled *Gas Fluidization Technology,* edited by D. Geldart, John Wiley & Sons, 1986; and in U.S. Pat. No. 4,202,673. The teachings of these references regarding nonmechanical valves are incorporated herein by reference. As catalyst particles enter lift conduit 18, a lift fluid which preferably comprises hydrogen enters the bottom of the lift conduit 18 through a conduit 16 and transports the catalyst particles upwardly through lift conduit 18 to the top 20 of the stacked reactor arrangement 22, which the particles and lift fluid enter.

Catalyst flows from the top to the bottom of the stacked reactor arrangement 22, passing first through a reduction zone, in which a hydrogen-rich gas contacts and reduces the oxidized catalyst particles, and from there through multiple stages of reaction in which process fluids contact the catalyst particles. The term "hydrogen-rich gas" as used herein refers to a gas that has a hydrogen concentration of greater than 50 mol-%. Details of the contacting beds and other internals of the stacked reactor arrangement 22 are well known to those skilled in the art and permit continuous or intermittent flow of the catalyst particles from the top 20 of the stacked reactor arrangement 22 to a lower retention chamber 24 at the bottom of the stacked reactor arrangement 22. A purging fluid preferably comprising hydrogen enters lower retention chamber 24 through a conduit 26 at a rate that purges hydrocarbons from the catalyst particles in lower retention chamber 24.

Spent catalyst particles containing coke deposits flow from the bottom of the stacked reactor arrangement 22 through a lower conduit 28 that displaces hydrogen and hydrocarbons from the stream of spent catalyst particles to prevent any carry-over of hydrogen and hydrocarbon to the regenerator side of the process. At the bottom of lower conduit 28, a nonmechanical valve 30 operates in a manner similar to that described for nonmechanical valve 12 to transfer spent catalyst particles upwardly through a lift conduit 40. A regulating fluid enters valve 30 through a conduit 36 and a lift fluid enters the bottom of the lift conduit 40 through a conduit 38. Both the regulating and lift fluids, which preferably comprise nitrogen, are provided through a conduit 34 from a blower 32.

In a manner similar to that described for lift conduit 18, spent catalyst particles travel up through lift conduit 40 to the regenerator side of the process, entering into an upper section 42 of a sorption-desorption vessel 44. On the regenerator side, the catalyst particles flow downward from the sorption-desorption vessel 44, through a regenerator vessel 100 and a nitrogen seal drum 160, and to a lock hopper arrangement 170 in a moving packed bed of catalyst. The internals of the sorption-desorption vessel 44, the regenerator vessel 100, the nitrogen seal drum 160, and the lock hopper arrangement 170 permit continuous or intermittent flow of catalyst particles.

Sorption-desorption vessel 44 is a stacked arrangement of two sections that contain three zones. The upper section 42 of sorption-desorption vessel 44 comprises a zone for disengaging the spent catalyst particles from the lift and regulating fluids. In addition, the upper section 42 maintains a volume of catalyst particles to balance transitory differences in the flow that may occur during intermittent transport of catalyst particles through the stacked reactor arrangement 22 and the regenerator side of the process. The lift and regulating fluids exit the disengaging section 42 and are recycled through a conduit 46 to the blower 32. The spent catalyst particles exit the upper section 42 through an internal conduit 54 that extends downward into a lower section 56. Although not shown in FIG. 1, the upper section 42 may also comprise means for separating broken or chipped catalyst particles and catalyst fines from whole catalyst particles and from lift and regulating fluids.

The lower section 56 of sorption-desorption vessel 44 contains a catalyst bed 60 for sorption and a catalyst bed 70 for desorption. The internal conduit 54 transfers spent catalyst particles from the upper section 42 to the sorption bed 60 in the lower section 56. Catalyst bed 60 maintains a volume of catalyst that sorbs most of the water that is present in a slip stream of a hereinafter-described flue gas/recycle gas stream. The slip stream is generally from 0.1 to 99.9%, and preferably from 1 to 20%, and more preferably from 5 to 10%, of the flue gas/recycle gas stream. The slip stream, which has the same composition as the flue gas/recycle gas stream, typically contains from 5000 to 100000 mol-ppm water, from 1000 to 5000 mol-ppm hydrogen chloride, and from 25 to 100 mol-ppm chlorine. The slip stream consists not only of gas that is ultimately recycled to the regenerator vessel 100 but also of gas that is vented from the process. The slip stream is withdrawn from the flue gas/recycle gas stream that flows through a conduit 95. The slip stream passes through a conduit 82 to a blower 80. The slip stream leaves the blower 80 through a line 78 and enters a cooler 76. Cooler 76 reduces the temperature of the slip stream to a temperature at which the catalyst in the sorption bed 60 is maintained. Typically, the slip stream enters cooler 76 at from 700 to 1000° F. (371 to 538° C.), and exits cooler 76 at from 50 to 250° F. (10 to 121° C.). In order to minimize the possibility of corrosion due to condensation of droplets of hydrochloric acid from the slip stream, preferably the exit temperature of cooler 76 is not below the dew point of the slip stream. After cooling, the slip stream flows through a conduit 77 and enters the sorption bed 60.

The sorption bed 60 is formed in part by an annular baffle 58, which is preferably an annular distributor. The cooled slip stream enters into an annular space 62 defined by annular baffle 58 and the wall of the lower section 56. Space 62 distributes the slip stream around the bottom of the annular baffle 58 and upward into the sorption bed 60 for countercurrent flow with the catalyst. The residence time of catalyst within the sorption bed 60 is principally governed by the length of annular baffle 58 and is typically two hours.

After sorptive removal of most of its water in bed 60, the slip stream exits the top of the sorption bed 60. The top of the sorption bed 60 is generally at the elevation of the lower end of the internal conduit 54. Thus, a space 52 is defined in part by the top of the sorption bed 60, the outer surface of the wall of the conduit 54, and the inner surface of the wall of the sorption-desorption vessel 44. The slip stream disengages from catalyst particles in this space 52 and then exits the sorption-desorption vessel 44 via a conduit 64. The concentration of water in the slip stream exiting the sorption bed 60 is generally less than 50000 mol-ppm, typically from 5000 to 50000 mol-ppm, and preferably from 5000 to 20000 mol-ppm, and corresponds to water removal from the slip stream entering the sorption bed 60 of generally from 5 to 95%.

In addition to water, other components such as hydrogen chloride and chlorine may also be removed by sorption from the slip stream in the sorption bed 60. For hydrogen chloride, for example, the concentration in the slip stream exiting sorption bed 60 is typically from 10 to 1000 mol-ppm. For chlorine, which at the same sorption conditions is more readily sorbed than hydrogen chloride, the concentration of chlorine in the slip stream exiting sorption bed 60 is typically from 1 to 100 mol-ppm. The water content of the catalyst particles exiting the bottom of sorption bed 60 could be as much as 4% by weight of the catalyst weight if the contact time is sufficiently long and if the slip stream has sufficiently low concentrations of components other than water that compete with water for sorption on the catalyst particles. But typically the water content of the catalyst exiting the bottom of sorption bed 60 is from 1 to 3%. Because of sorption of hydrogen chloride and chlorine in sorption bed 60, the chloride content of the catalyst particles exiting the bottom of sorption bed 60 could be as high as 7% by weight of the catalyst weight if the slip stream is sufficiently dry and the contact time is sufficiently long, but from 0.8 to 1.2% is a more typical amount.

For a sorption bed of the kind shown in the FIG. 1, the rate of catalyst movement through the sorption bed 60 may range typically from 200 to 6000 pounds per hour (90.7 to 2721.6 kilograms per hour). For this range of catalyst flow rates, the length of the sorption bed 60 typically ranges from 4 to 20 feet (1.22 to 6.1 meters). The diameter of the cylindrical bed is typically from 3 to 20 feet (0.91 to 6.10 meters). For example, for a catalyst flow rate of 2000 pound per hour (907.2 kilogram per hour), a cylindrical catalyst bed may be 10 feet (3.05 meters) in diameter and 13 feet (3.96 meters) in length. Where higher catalyst flow rates are used, larger bed diameters may be required.

As mentioned previously, the slip stream exits the sorption-desorption vessel 44 via a conduit 64. A portion of the slip stream passes through a conduit 66 and is vented from the process. Venting of this portion of the slip stream allows for introduction of a hereinafter-described make-up stream into the regenerator vessel 100. The remainder of the slip stream passes through a conduit 68 and combines with the gas that is being recycled to a combustion zone 114 and that flows through a conduit 97 and that has not passed through the sorption bed 60. Alternatively, the remainder of the slip stream passing through the conduit 68 could be routed to line 93, where it would combine with the gas entering the suction of blower 90. The advantage of this alternate routing is that the blower 90 could provide the required circulation not only for the main flow of the flue gas/recycle gas but also for the slip stream as well, thereby eliminating the need for blower 80. Two other possible options also eliminate the need for the blower 80. The first option is to partially restrict the gas flow through the conduit 97 so that, of the total gas flow in the conduit 95, a desired rate of gas flows through the sorption bed 60 and returns in the conduit 68, even without the blower 80. The second option is to eliminate the conduit 97, as well as the blower 80. In this option, all of the gas flow from the blower 90 flows through the sorption bed 60 and, after venting, the remainder is recycled to the combustion zone 114.

As also mentioned previously, after having sorbed water in the sorption bed 60 catalyst particles containing the sorbed water exit the bottom of sorption bed 60. The catalyst particles then flow around a conical baffle 74 and through an annulus 73 formed by a vertical section 79 of an annular baffle 72 and by a cylindrical baffle 75 attached to the bottom of the conical baffle 74. Catalyst then flows downward from annulus 73 into desorption bed 70, which is formed in part by an annular baffle 86. Although a portion of the slip stream flowing in the line 64, such as the vent stream flowing in the line 66, could be used to desorb water from the catalyst in the desorption bed 70, in FIG. 1 the stream that desorbs water from the catalyst in the desorption bed 70 is a hereinafter-described seal drum vent gas stream. The seal drum vent gas stream, which is also referred to as the desorption inlet stream, passes through a conduit 178 and enters the desorption bed 70. The desorption inlet stream enters into an annular space 88 defined by the annular baffle 86 and the wall of the lower section 56. The desorption inlet stream is distributed downward through the space 88. At the bottom of the annular baffle 86, the desorption inlet stream reverses direction and flows inward and upward into the desorption bed 70, where the desorption inlet stream and the catalyst flow countercurrently. The length of annular baffle 86 determines in large part the residence time of catalyst within the desorption bed 70, which is typically two hours.

After having desorbed most of the water from the catalyst particles passing through the desorption bed 70, the seal drum vent gas stream, which now contains the desorbed water and is referred to hereinafter as the desorption outlet stream, exits the top of the desorption bed 70. The top of the desorption bed 70 is generally at the elevation of the lower end of the annulus 73. A space 92 is defined by the top of the desorption bed 70, the annular baffle 72, and the inner surface of the wall of the lower section 56. The desorption outlet stream disengages from catalyst particles in the space 92 and then exits the sorption-desorption vessel 44 via a conduit 84. Generally, from about 30% to about 90% of the water on the catalyst that enters the desorption bed 70 is removed and exits the desorption bed 70 with the desorption outlet stream rather than with the exiting catalyst particles. The concentration of water in the desorption outlet stream exiting the desorption bed 70 is generally from 10000 to 100000 mol-ppm.

Besides desorbing water, the desorption bed 70 may also desorb other components that are sorbed on the catalyst particles that enter the desorption bed 70. In the case of chloride, however, desorption should be minimized, because chloride that is desorbed from the catalyst particles in the desorption bed 70 is vented through the conduit 84 and lost from the process. This loss of chloride increases both capital and operating costs of the process, by decreasing the activity of the catalyst particles, by increasing the need for removing hydrogen chloride and/or chlorine from the desorption outlet stream, and by increasing the amount of chloride that must be added to the regeneration process as make-up. If, because of desorption of chloride from the catalyst in the desorption bed 70, the concentration of chlorine or hydrogen chloride in the desorption outlet stream exiting through conduit 84 is still unacceptably high, then the desorption outlet stream may be passed through any of the previously described conventional means for removing chlorine and hydrogen chloride from a gas stream.

For a desorption bed such as that shown in the FIG. 1, where the rate of catalyst movement through the desorption bed 70 is the same as that previously mentioned for the sorption bed 60, the diameter is typically the same as that of the sorption bed 60 while the length of the desorption bed 70 typically ranges from 4 to 20 feet (1.22 to 6.1 meters).

After water desorption in the desorption bed 70, spent catalyst particles exit the desorption-sorption vessel 44 and enter the regenerator vessel 100 by means of catalyst particle inlet conduits 94. The regenerator vessel 100 has an upper section 112 and a lower section 124 and is cylindrical in form. Looking first at the flow of catalyst particles, conduits 94 discharge catalyst particles into an annular catalyst bed 110 formed by an outer catalyst retention screen 108 and an inner catalyst particle retention screen 106. The volume of catalyst particles in the upper section 112 is located in the combustion zone that is generally denoted as 114. Retention screens 106 and 108 are cylindrical in form and concentric with the regenerator vessel 100. Retention screens 106 and 108 are perforated with holes that are large enough to allow gas to pass through the annular catalyst bed 110 but to not permit the passage of catalyst particles therethrough. Outer retention screen 108 extends downward from the bottom of conduits 94 to a swedge section 121 of regenerator vessel 100. Supports 104 guide the top of outer retention screen 108 and help to keep it centered in regenerator vessel 100. Inner retention screen 106 is attached to the top head of regenerator vessel 100 and extends downward therefrom to a point slightly above the lower end of outer retention screen 108. The bottom 122 of the inner retention screen 106 is open to allow oxygen-enriched and chlorine-containing make-up gas to flow upward from a central portion 126 to a central section 118, as will be described hereinafter. The bottom 120 of the annular catalyst bed 110 is open to allow catalyst particles to empty from the catalyst bed 110 into the central portion 126 of regenerator vessel 100. From about the bottom of opening 120, the catalyst particles enter the lower section 124 of the regenerator vessel 100. The volume of catalyst particles in the lower section 124 is located in a hereinafter-described reconditioning zone that is generally denoted as 130 and a hereinafter-described cooling zone that is generally denoted as 152. Catalyst particles in a reconditioning bed 128 in the reconditioning zone 130 are statically supported by catalyst particles that extend through an annulus 132 to a cooling bed 142 of the cooling zone 152. The catalyst particles in the cooling bed 142 are statically supported by catalyst particles that extend through a conduit 164 in the end closure of lower vessel section 124 and to a purging bed 166 of a nitrogen seal drum that is generally denoted as 160. Catalyst particles in the purging bed 166 are supported by catalyst particles that extend through a conduit 174 in the bottom end closure of nitrogen seal drum 160. The catalyst particles are periodically transferred by withdrawing a predetermined volume of catalyst through conduit 174 which in turn allows all the catalyst particles to slump downward through the previously described beds and zones in sorption-desorption vessel 44, regenerator vessel 100, and nitrogen seal drum 160.

As the catalyst particles travel downward through the regeneration process they pass first through the combustion zone 114 that includes the previously described annular catalyst bed 110. Looking now at the flows of gas streams in the regeneration system, recycle gas that enters the combustion zone 114 through conduit 67 is distributed in an annular chamber 116 that extends around outer retention screen 108 and is defined on its sides by outer retention screen 108 and the vessel wall of upper vessel section 112 and on its bottom by swedge section 121. An upper portion 102 of inner screen 106 is impervious to gas flow, or blanked off to prevent gas flow, from chamber 116 across the top of the regenerator vessel 100. As the recycle gas passes through catalyst bed 110, the catalyst is partially regenerated. Oxygen is consumed in the combustion of coke and flue gas is collected in central section 118. The process of combusting coke produces water and also removes chloride from the catalyst particles, and therefore the flue gas contains not only water and carbon dioxide but also chloro-species such as chlorine and hydrogen chloride.

The gas that collects in central section 118 of regenerator vessel 100 includes not only flue gas from catalyst bed 110, but also oxygen-enriched and chlorine-containing make-up gas flowing upward from central portion 126. Because the gas that collects in central section 118 includes flue gas from the catalyst bed 110 and also comprises gas that will be recycled in the combustion zone 114, the gas is usually denoted "flue gas/recycle gas." The flue gas/recycle gas stream leaves central section 118 through a conduit 96 and enters a cooler 98. Cooler 98, which usually removes some of the heat from the flue gas/recycle gas stream during normal operation, may not be necessary, however, if cooler 76 removes a sufficient amount of heat from the slip stream of the flue gas/recycle gas. The flue gas/recycle gas stream flows to a blower 90 through a conduit 93. The flue gas/recycle gas stream leaves the blower 90 through the conduit 95. The slip stream, which is the portion of the flue gas/recycle gas stream that passes to the sorption bed 60, flows through the conduit 82 as described previously. The slip stream includes the portion of the flue gas/recycle gas stream that passes through the sorption bed 60 and is rejected or vented from the combustion zone 114 as well as the portion of the flue gas/recycle gas stream that passes through the sorption bed 60 and is recycled to the combustion zone 114. The remainder of the flue gas/recycle gas stream, which is usually the bulk of the flue gas/recycle gas stream and comprises that portion of the flue gas/recycle gas stream that is recycled in the combustion zone 114 without passing through the sorption bed 60, passes through the conduit 97. The portion of the flue gas/recycle gas stream flowing through the line 97 combines with the portion of the sorption outlet stream flowing through the line 68, and the combined stream, which is called the recycle gas stream, flows through the line 69 to a heater 71. The heater 71 heats the recycle gas stream to carbon-burning temperatures during start-up and to a lesser degree adds heat to the recycle gas stream during normal operation. The heater 71 operates in conjunction with coolers 76 and 98 to regulate the temperature of the recycle gas stream. During normal operation, the utility requirements of the heater 71 can be minimized by adding a heat exchanger (not shown) that exchanges heat from the gas flowing in the conduit 78 to the gas flowing in the conduit 68. The recycle gas stream passes through the conduit 67 and enters the upper section 112 of regenerator vessel 100.

A blower 150 supplies air as make-up gas to the combustion zone 114. This make-up gas is introduced initially, however, to the reconditioning zone 130 and the cooling zone 152, which are in the lower section 124 of the regenerator vessel 100 and from which most of the oxygen in the make-up gas ultimately makes its way to the combustion zone 114. The make-up gas stream is added to regenerator vessel 100 at a rate of addition generally equal to the rate of the gas venting from the conduit 66. Blower 150 draws air through a conduit 154 to its suction and discharges the air stream through a conduit 158 to a drier 156 that reduces the moisture content of the air stream. The dry air stream passes through a conduit 162 and divides into two portions. One portion of the air stream from conduit 162 flows through a conduit 141 and enters cooling bed 142. After cooling the catalyst in cooling bed 142 in a manner that is described hereinafter, this first portion of the dry air stream exits the regenerator vessel 100 through a conduit 146. The second portion of the dry air stream from conduit 162 flows through a conduit 145 and combines with the first portion of the dry air stream flowing through the conduit 146. The now-recombined dry air stream passes through a conduit 147 into a heater 140 which heats the air stream to about 1000° F. (538° C.). The heated dry air stream passes through a conduit 138 and mixes with a chlorine-containing stream from a conduit 136 that gives the contents of the mixed stream a chlorine concentration of about 0.11 mol-%. The mixed stream of chlorine and heated, dry air passes through a line 139 and enters the reconditioning zone 130. Although in this arrangement, the entire heated dry air stream discharged from the heater 140 is transferred by the conduits 138 and 139 to the reconditioning zone 130, other regenerator arrangements may split the heated dry air stream from conduit 138 between a drying zone and a redispersion zone.

Catalyst below combustion zone 114 is contacted with the mixed stream of chlorine and heated dry air that flows through conduit 138 and enters the reconditioning zone 130. The reconditioning zone 130 is preferably of the kind disclosed in U.S. Pat. No. 5,457,077 (Williamson et al.). Most of the entering gas, including most of the oxygen as well as some of the chlorine and some hydrogen chloride produced from the chlorine, reaches an upper portion of the reconditioning zone 130 and passes into the central portion 126 of the regenerator vessel 100. Central portion 126 is formed in part by the cylindrical wall of the lower section 124. The gas that passes through the central portion 126 passes upward through the bottom opening 122 of the inner retention screen 106 and enters the central section 118. Although in this arrangement, all of the gas that reaches the top of the reconditioning zone 130 transfers to the central portion 126, other regenerator arrangements may split the gas between the central portion 126 and a gas collection volume that collects some of the gas and vents it from the regenerator vessel 100.

The catalyst at the bottom of the central portion 126 flows into the reconditioning zone 130 of regenerator vessel 100. Reconditioning bed 128 is formed in part by an annular baffle 136 that is concentrically located with respect to the regenerator vessel 100. The previously-described heated, dried, chlorine-containing air stream enters via the conduit 139 into an annular volume 134, which is defined in part by the annular baffle 136 and by the wall of lower vessel section 124. An open bottom of annular volume 134 allows gas to be distributed about the entire circumference of the annular volume 134 and about the reconditioning bed 128. The operating conditions of the reconditioning zone 130, which generally comprise a temperature of from 700 to 1200° F. (371 to 649° C.), are sufficient to oxidize and disperse the catalyst metal and to remove water from the catalyst. Catalyst residence time within the reconditioning zone 130 is governed principally by the length of annular baffle 136 and is typically two hours.

After removal of coke and reconditioning of catalyst particles in the regenerator vessel 100, the catalyst particles are in a partially-regenerated condition, in which the catalyst metal is oxidized and redispersed and in which the catalyst particles are dried. The partially-regenerated catalyst particles flow from the bottom of the reconditioning bed 128 to the top of the cooling bed 142 past an arrangement of baffles that is similar to the previously-described arrangement of baffles between the sorption zone 60 and the desorption zone 70. Thus, the catalyst particles flow through an annulus 132 that is formed between annular baffle 148, which is similar to annular baffle 72, and a baffle 131, which consists of a conical baffle which is similar to the conical baffle 74 and a cylindrical baffle which is similar to the cylindrical baffle 75. Catalyst then flows downward from annulus 132 into the cooling bed 142, which is defined in part by an annular baffle 144. The previously-described dry air stream flowing in conduit 141 enters into an annular volume 143, which is defined in part by the annular baffle 144 and by the wall of lower vessel section 124. The air stream flows downward through annular volume 143, is distributed over the entire cross-section of the cooling bed 142, and flows upwardly and countercurrently to the catalyst. The operating conditions of the cooling zone 152 are generally sufficient to cool the catalyst that exits the cooling zone 142 to a temperature of from about 200 to about 500° F. (93 to 260° C.). The catalyst in the cooling bed 142 is contacted with the air stream at an air flow rate that establishes an air thermal flow rate such that the ratio of the air thermal flow rate to the catalyst thermal flow rate in the cooling bed is generally less than 0.9 and preferably less than 0.85, or more than 1.15 and preferably more than 1.2. Thermal flow rate is defined as the product of mass flow rate and the average heat capacity through the operating temperature range. After cooling the catalyst, the air stream collects in an annular volume 149 which is defined in part by the annular baffle 148 and the wall of the lower vessel section 124. From annular volume 149 the cooling air exits the regenerator vessel 100 through the conduit 146, as described previously.

The conduit 164 transfers the cooled partially-regenerated catalyst to a nitrogen seal drum 160. A conduit (not shown) may provide a location for introducing additional catalyst into the catalyst transport system via the conduit 164. The nitrogen seal drum 160 functions as a purging vessel or zone for displacing oxygen gas, as well as carbon monoxide and carbon dioxide, if any, from the stream of cooled partially-regenerated catalyst particles in order to prevent carry-over of any oxygen into the reactor side of the process. Seal drums are well known to persons skilled in the art and may be used in any of their current, well-known forms to supply a flow of catalyst into the conduit 174. In the embodiment shown in FIG. 1, the nitrogen seal drum 160 contains an annular baffle 172, which in part defines the purging bed 166. The annular baffle 172 and the wall of the nitrogen seal drum 160 define an annular space 168, into which a nitrogen-containing seal drum inlet stream enters through a line 176. The flow rate of the seal drum inlet stream through the purging bed 166 is preferably at a rate less than that effective to terminate the flow of catalyst particles through the purging bed 166, thereby allowing the catalyst particles to flow at least intermittently through the purging bed 166. Moreover, the flow rate of the seal drum inlet stream through the purging bed 166 is preferably at a rate less than that effective to fluidize the catalyst in the purging bed 166. The seal drum inlet stream countercurrently purges oxygen-containing species from the catalyst in purging bed 166 at a rate that is sufficient to purge oxygen from the total void volume in the purging bed 166. The total void volume in the purging bed 166 is defined as the volume of the pores within the catalyst particles plus the voidage volume between the catalyst particles in the purging bed 166. The physical characteristics of the catalyst determine the volume of the pores within the catalyst particles, and the voidage volume between the catalyst particles depends on how densely the catalyst particles are packed in the purging bed 166. Since the rate at which the total void volume enters the purging bed 166 depends on the rate of flow of the catalyst particles, the flow rate of the seal drum inlet stream that is effective to purge oxygen from the total void volume depends on the rate of flow of the entering catalyst particles. Preferably, the ratio of the volume of seal drum inlet stream to the total void volume entering the purging bed 166 is greater than 1.0, provided that the seal drum inlet stream does not interfere with the flow of catalyst particles as previously described in this paragraph. Depending on the physical characteristics of the catalyst, the ratio of the volume of seal drum inlet stream to the total void volume entering the purging bed 166 may be between 2.5 and 3.5. Preferably the residence time of the catalyst particles in the purging bed 166 is between 0.1 and 60 minutes, and more preferably between 0.5 and 30 minutes.

A nitrogen seal drum outlet stream containing nitrogen and oxygen exits from the nitrogen seal drum 160 through the line 178. Even though the nitrogen seal drum inlet stream enters at ambient temperature, the nitrogen seal drum outlet stream exits the nitrogen seal drum 160 at an elevated temperature as a result of contact in the nitrogen seal drum 160 with the catalyst, which enters the nitrogen seal drum 160 at or near to the operating temperature of the cooling zone 152. Thus, the temperature of the nitrogen seal drum outlet stream is generally above ambient temperature. Unlike prior art processes where the nitrogen seal drum outlet stream passes to the regenerator vessel 100, in the embodiment shown in FIG. 1 the nitrogen seal drum outlet stream is used as the desorption inlet stream. When used as the desorption inlet stream, the temperature of the nitrogen seal drum outlet stream is preferably the desired operating temperature of the desorption bed 70, and the flow rate of the nitrogen seal drum outlet stream is preferably sufficient to achieve the desired gas hourly space velocity of the desorption bed 70.

After removal of oxygen from the catalyst particles in the nitrogen seal drum 160, a conduit 174 transfers the catalyst particles to a lock hopper arrangement 170. The lock hopper arrangement 170 controls the transfer of the partially-regenerated catalyst particles back to the stacked reactor arrangement 24 via the previously described nonmechanical valve 12 and lift conduit 18. Lock hopper arrangements are well known to persons skilled in the art and may be used in any of their current, well-known forms to supply a flow of catalyst into the lower conduit 10.

Figure 2:
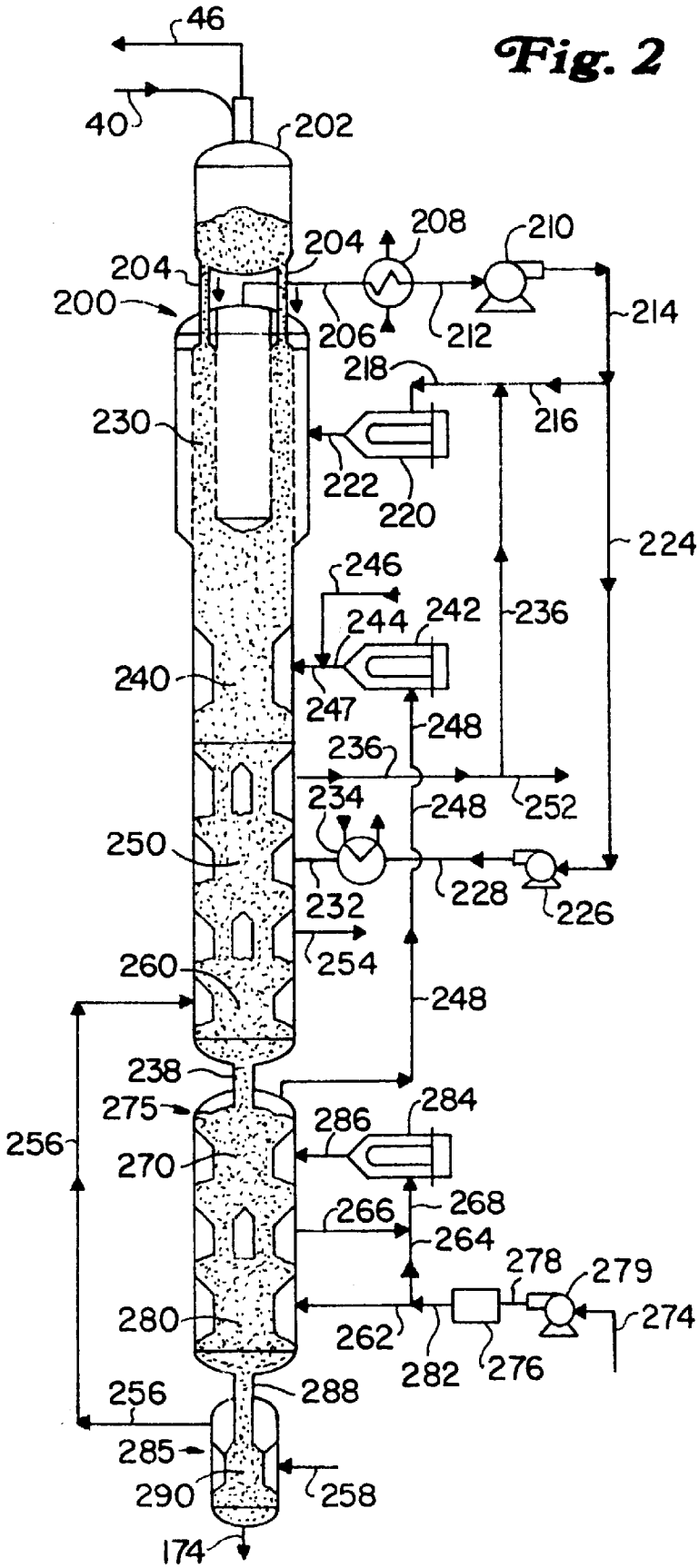
FIG. 2 is a schematic illustration of a variation of the embodiment in FIG. 1.

FIG. 2 illustrates an embodiment of the invention where the catalyst particles are at least partially regenerated prior to their being used to sorb water from the flue gas/recycle gas, in contrast to the embodiment in FIG. 1 where the catalyst particles are used to sorb water without first being at least partially regenerated. Except for this difference, parts of FIG. 1 correspond directly to parts of FIG. 2, and therefore those corresponding parts have been given the same reference numbers in both Figures. Accordingly, in the process depicted in FIG. 2, the lines 40, 46, and 174 interconnect with other equipment and lines that are shown in FIG. 1 but which for the sake of brevity are not shown in FIG. 2.

Referring first to the flow of catalyst in FIG. 2, spent catalyst enters a disengaging vessel 202 and flows through catalyst inlet conduits 204 into the top of a regenerator vessel 200. In regenerator vessel 200, the catalyst flows downward by gravity through an annular bed 230 for combusting coke deposits on the catalyst and through a cylindrical bed 240 for redispersing the metal on the catalyst. The catalyst flows downward through a cylindrical bed 250 for sorbing water from a slip stream of the flue gas/recycle gas and through another cylindrical bed 260 for desorbing water from the catalyst. Catalyst exits the bottom of regenerator vessel 200 through a catalyst conduit 238, and enters the top of a drying-cooling vessel 275. In drying-cooling vessel 275, the catalyst flows first through a cylindrical bed 270 for removing water from the catalyst to the desired degree of dryness in order to return the catalyst to the stacked reactor arrangement (not shown in FIG. 2). Then the catalyst flows through another cylindrical bed 280 for cooling the catalyst. The drying-cooling vessel 275 could, of course, be eliminated if the catalyst that exits the bottom of the regenerator vessel 200 is sufficiently dry for use in the reactors. Catalyst exits the bottom of drying-cooling vessel 275 through a catalyst conduit 288 and enters the top of a purging vessel 285. In purging vessel 285, the catalyst flows through a cylindrical bed 290 for purging oxygen from the catalyst. Finally, the catalyst exits the bottom of purging vessel 285 through the conduit 174. The annular and cylindrical catalyst beds in FIG. 2 are formed in the manners described previously for like catalyst beds in FIG. 1, and a suitable arrangement for the metal redispersion bed 240 is shown in previously mentioned U.S. Pat. No. 5,397,458 (Micklich et al).

Turning now to the gas flows in FIG. 2, a flue gas/recycle gas stream exits regenerator vessel 200 and flows through a conduit 206 to a cooler 208. After cooling, the flue gas/recycle gas stream flows through a conduit 212, a blower 210, and a conduit 214. The bulk of the flue gas/recycle gas stream is recycled to the coke combustion bed 230 through a conduit 216, a conduit 218, a heater 220, and a conduit 222. A slip stream of the flue gas/recycle gas stream flows to the water sorption bed 250 through a conduit 224, a blower 226, a conduit 228, a cooler 234, and a conduit 232. The slip stream and the catalyst flow countercurrently in the water sorption bed 250, and after sorptive removal of most of its water the slip stream exits the water sorption bed 250 through a conduit 236. A portion of the slip stream in conduit 236 vents through a conduit 252 from the process, and the remainder returns through a conduit 236 to combine with the flue gas/recycle gas stream in conduit 216.

An air stream, which ultimately becomes make-up gas for the combustion bed 230, enters the process by flowing through a conduit 274, a blower 279, a conduit 278, a drier 276, and a conduit 282. The air stream in conduit 282 divides into two portions. One portion of the air stream from conduit 282 enters cooling bed 280 by flowing through a conduit 262. The air stream in conduit 262 and the catalyst flow countercurrently in cooling bed 280, and after cooling the catalyst the air stream exits the cooling bed 280 through a conduit 266. The other portion of the air stream from conduit 282 flows through a conduit 264 and combines with the air stream flowing through the conduit 266. The combined air stream flows through a conduit 268, a heater 284, and a conduit 286. The air stream and the catalyst flow countercurrently in the drying bed 270, and after removing water from the catalyst the air stream exits the drying bed 270. The air stream then flows through a conduit 248, a heater 242, and a conduit 244, where it combines with a chlorine-containing stream in line 246. A gas stream of air and chlorine flows through a line 247 and enters the metal redispersion bed 240, where the catalyst and the stream of air and chlorine flow countercurrently. After catalyst metal redispersion, the gas stream exits the metal redispersion bed 240, combines with the flue gas that flows radially inward from the combustion bed 230, and forms the flue gas/recycle gas stream.

A nitrogen stream, which ultimately becomes the desorption gas for the desorption bed 260, flows through a conduit 258 and enters the purging bed 290, where it countercurrently contacts the catalyst. The countercurrent contacting not only purges oxygen from the catalyst but also heats the nitrogen stream, thereby making it suitable for desorbing water in the desorption bed 260. The nitrogen stream exits the purging bed 290, passes through a line 256, and enters the desorption bed 260. The nitrogen stream and the catalyst flow countercurrently in the desorption bed, and after water desorption the gas stream exits the desorption bed 260 and is rejected from the process.

An alternative embodiment to that shown in FIG. 2 consists of changing the routing for the slip stream that exits the water sorption bed 250. This embodiment would withdraw from the regenerator vessel 200 via the conduit 236 only the portion of the slip stream that would be vented from the process through the conduit 252 rather than the entire slip stream. The remainder of the slip stream would exit the water sorption bed via the metal redispersion bed 240 not through the conduit 236. In this embodiment, the remainder of the slip stream would flow upward within the regenerator vessel 200, would mix with the other gases in the metal redispersion bed 240, and would combine with the flue gas as described previously for the gases that exit the metal redispersion bed 240 in FIG. 2. If the slip stream had a low water content, this embodiment could increase the concentration of chlorine within the metal redispersion bed 240.

This invention is not limited to the particular arrangements of sorption zone, desorption, and regeneration zones that are depicted in FIGS. 1 and 2. For example, in an alternative arrangement to that shown in FIG. 1, the sorption-desorption vessel 44 and the regenerator vessel 100 may be combined into one common, vertically-extended vessel that contains all of their beds (i.e., 60, 70, 110, 128, 142, and others). In such a single, common vessel, the beds may each be in separate sections of the vessel. In a variation on the arrangement in FIG. 2, the sorption bed 250 and desorption bed 260 may be removed from the regenerator vessel 200 and located in a vessel that is separate and between the regenerator vessel 200 and the drying-cooling vessel 275. In variations on both FIGS. 1 and 2, the separate purging vessel (160 in FIG. 1 and 285 in FIG. 2) may be eliminated by incorporating the purging bed (166 in FIG. 1 and 290 in FIG. 2) into the vessel (100 in FIG. 1 and 275 in FIG. 2) immediately above the purging vessel.

WATER SORPTION EXAMPLES

A gamma-alumina catalyst support (catalyst base) of a commercial continuous reforming catalyst was tested for water sorption. The catalyst base had a nominal chloride content of less than 0.05 wt-%, a nominal platinum content of less than 0.01 wt-%, and a usual as-received loss on ignition (LOI) at 500° C. (932° F.) of about 1–2 wt-%. The surface area of the catalyst base was about 185–195 $m^2$/gram. The amount of water on the catalyst support was measured by LOI at 500° C. (932° F.).

For each test, a tubular quartz reactor having a thermocouple extending along the longitudinal axis of the reactor was used. The reactor was loaded with three annular beds of the catalyst base by pouring the catalyst base for the first bed into the reactor in the annular space between the thermocouple and the wall of the reactor, inserting a quartz wool pad, pouring in the catalyst base for the second bed, inserting a quartz wool pad, and then pouring in the catalyst base for the third bed. Thus, each bed was separated from each adjacent bed by a quartz wool pad. The placement of the thermocouple enabled the temperature within each bed to be measured.

After loading, for each test the tubular quartz reactor was placed in a tubular furnace. A gas stream containing nitrogen and water passed through the reactor at approximately atmospheric pressure for twelve hours. The water content of the gas was 1, 3, 5, or 10 mol-%, and the temperature of the beds was 60° C. (104° F.), 150° C. (302° F.), 250° C. (482° F.), 350° C. (662° F.), or 450° C. (842° F.). Over the twelve-hour period an amount of water passed through the reactor that is in excess of the total water sorption capacity of the catalyst base in all three beds at the test conditions. In addition, the twelve-hour period was a sufficient period of time for water to sorb on the catalyst base in all three beds and for all three beds to equilibrate with the gas at the test conditions. After the twelve hours, the flow of gas was stopped and the reactor was sealed and cooled to room temperature.

Samples for each test were taken from each bed and the samples were analyzed to an accuracy of +/−0.1 wt-% for LOI at 500° C. (932° F.). The three LOI results differed by 2 wt-% or less. The three LOI results were averaged, and a single average LOI was reported. Experimental repeatability of the average LOI from two tests at the same test conditions was +/−0.2 wt-%.

Table 1 summarizes the water sorption data:

TABLE 1

WATER ADSORPTION DATA
AVERAGE LOI AT 500° C. (932° F.)

| | Water content of gas, mol-% | | | | |
|---|---|---|---|---|---|
| Bed temperature, ° C. | 1 | 3 | 5 | | 10 |
| 60 | — | — | — | approx. | 7.43 |
| 150 | 1.41 | 2.17 | 2.11 | | 2.23 |
| 250 | 0.65 | 1.30 | — | | 1.29 |
| 350 | 0.25 | 0.59 | — | | 0.80 |
| 450 | 0.0 | 0.15 | — | | 0.25 |

These data show that water sorption by the catalyst base is strongly dependent on temperature, increasing rapidly as the temperature drops below about 100° C. (212° F.). These data also show that water sorption is not strongly dependent on the gas water content, remaining about the same even as the water concentration increases above about 3 mol-%.

CHLORIDE RETENTION EXAMPLE

A test of a commercial continuous reforming catalyst showed that little or no chloride stripping occurred at water sorption conditions. The catalyst had a nominal composition of 0.381 wt-% platinum (volatile free) and 0.3 wt-% tin (volatile free) on a gamma alumina support. The catalyst had a nominal surface area of about 186 $m^2$/gram, a chloride content of 0.98 wt-% chloride, a nominal coke content of less than 0.1 wt-%, and a nominal as-received LOI at 500° C. (932° F.) of 0.7 wt-%.

Approximately 300 cc of the catalyst was loaded into a tubular quartz reactor having a thermocouple extending along the longitudinal axis of the reactor, thereby forming an annular catalyst bed in the reactor. The diameter of the catalyst bed was approximately 1.75 inches and its length was approximately 9 inches. A thermocouple extending along the axis of the reactor was capable of measuring the temperature within the bed. After loading, a gas stream containing 95 mol-% nitrogen and 5 mol-% water passed through the reactor at a gas hourly space velocity of 400 $hr^{-1}$ for sixteen hours. The bed temperature was 150° C. (302° F.) and the bed pressure was approximately atmospheric. After the sixteen hours, the gas flow was stopped, the reactor was sealed, and the reactor was cooled to room temperature. Samples were taken from the top and the bottom of the bed and analyzed for chloride. The sample from the top of the bed had a chloride content of 0.93+/−0.07 wt-% and the sample from the bottom of the bed had a chloride content of 0.98+/−0.07 wt-%.

These data show no stripping of chloride is detectable within experimental error at these water sorption conditions.

What is claimed is:

1. An apparatus for regenerating catalyst particles, said apparatus comprising:

(a) a water-generation section defined by a first vessel section;

(b) means for adding catalyst particles to said water-generation section and for contacting catalyst particles with a fresh regeneration gas in said water-generation section to at least partially regenerate catalyst particles and to produce a water-enriched regeneration gas;

(c) means for withdrawing catalyst particles from said water-generation section;

(d) a water-sorption section defined by a second vessel section;

(e) a first passageway for receiving said water-enriched regeneration gas from said water-generation section in said water-sorption section;

(f) means for adding catalyst particles to said water-sorption section and for contacting catalyst particles with said water-enriched regeneration gas in said water-sorption section to at least partially sorb water on catalyst particles and to produce a water-depleted regeneration gas;

(g) a second passageway for passing said water-depleted regeneration gas from said water-sorption section to said water-generation section to produce at least a portion of said fresh regeneration gas;

(h) a water-desorption section defined by a third vessel section;

(i) means for receiving catalyst particles from said water-sorption section and for contacting catalyst particles with a desorption gas in said water-desorption section to at least partially desorb water from catalyst particles and to produce a vent gas;

(j) means for collecting and withdrawing said vent gas from said water-desorption section; and (k) means for withdrawing catalyst particles from said water-desorption section.

2. The apparatus of claim 1 further comprising means for receiving catalyst particles from said water-desorption section in said water-generation section.

3. The apparatus of claim 2 further comprising:

(a) a purging vessel;

(b) means for receiving catalyst particles from said water-generation section and for contacting catalyst particles with a purge inlet gas in said purging vessel to at least partially purge hydrogen or oxygen from the total pore volume of catalyst particles and to produce a purge outlet gas;

(c) a third passageway for passing said purge outlet gas to said water-desorption section; and (d) means for withdrawing catalyst particles from said purging vessel.

4. The apparatus of claim 1 further comprising means for receiving catalyst particles from said water-generation section in said water-sorption section.

5. The apparatus of claim 4 further comprising:

(a) a purging vessel;

(b) means for receiving catalyst particles from said water-desorption section and for contacting catalyst particles with a purge inlet gas in said purging vessel to at least partially purge hydrogen or oxygen from the total pore volume of catalyst particles and to produce a purge outlet gas;

(c) a third passageway for passing said purge outlet gas to said water-desorption section; and (d) means for withdrawing catalyst particles from said purging vessel.

6. The apparatus of claim 1 further characterized in that said first passageway comprises means for cooling said water-enriched regeneration gas.

7. The apparatus of claim 1 further comprising a third passageway for passing said water-depleted regeneration gas from said water-sorption section to said water-desorption section.

8. The apparatus of claim 1 further characterized in that said means for withdrawing catalyst particles from said water-generation section comprises:

(a) a cooling section defined by a fourth vessel section;

(b) means for receiving catalyst particles from said water-generation section in said cooling section and for contacting catalyst particles with a cool gas in said cooling section to cool catalyst particles and to produce a heated gas; and (c) means for collecting and withdrawing said heated gas from said cooling section.

9. The apparatus of claim 1 further characterized in that said first vessel section, said second vessel section, and said third vessel section are defined by a regeneration vessel.

10. The apparatus of claim 1 further characterized in that said second vessel section and said third vessel section are defined by a sorption-desorption vessel.

* * * * *